US006523767B1

(12) United States Patent
Ramesohl

(10) Patent No.: US 6,523,767 B1
(45) Date of Patent: Feb. 25, 2003

(54) GRINDING ROLLER AND METHOD FOR THE MANUFACTURE THEREOF

(75) Inventor: Hubert Ramesohl, Bergisch Gladbach (DE)

(73) Assignee: KHD Humboldt Wedag AG, Cologne (DE)

( * ) Notice: Subject to any disclaimer, the term of this patent is extended or adjusted under 35 U.S.C. 154(b) by 114 days.

(21) Appl. No.: 09/639,417

(22) Filed: Aug. 14, 2000

(30) Foreign Application Priority Data

Aug. 14, 1999 (DE) ..... 199 38 652
Mar. 24, 2000 (DE) ..... 100 14 836

(51) Int. Cl.[7] ..... B02C 4/30

(52) U.S. Cl. ..... 241/293; 241/235; 241/300; 492/30; 492/45

(58) Field of Search ..... 241/235, 293, 241/300; 492/30, 33, 35, 36, 45

(56) References Cited

U.S. PATENT DOCUMENTS 4,617,709 A * 10/1986 Gundlach ..... 241/293
4,779,811 A * 10/1988 Takasaki ..... 241/293
5,203,513 A 4/1993 Keller et al.
5,269,477 A 12/1993 Buchholtz et al.
5,312,056 A 5/1994 Kä stingschäfer et al.
5,601,520 A 2/1997 Wollner et al.
5,704,561 A * 1/1998 Ansen et al. ..... 241/293
5,725,416 A * 3/1998 Russell ..... 241/293
5,755,033 A * 5/1998 Gunter et al. ..... 29/895.3
5,860,609 A 1/1999 Sommer et al.
6,086,003 A 7/2000 Gü nter et al.
6,283,902 B1 * 9/2001 Bakoledis ..... 492/30

FOREIGN PATENT DOCUMENTS

EP 0 563 564 B1 6/1997
EP 0 659 108 B1 10/1998

* cited by examiner

*Primary Examiner*—William Hong
(74) *Attorney, Agent, or Firm*—Sonnenschein, Nath & Rosenthal

(57) ABSTRACT

In order to create a surface armoring suitable for the autogenous wear protection with application of grid armoring technology that exhibits a long service life capability due to high wear-resistance and compressive strength and that can nonetheless be manufactured and repaired relatively simply and cost-beneficially overall, particularly for the grinding rollers of high-pressure roller mills for the pressure comminution of granular material, it is inventively proposed that depressions spaced from one another be formed in the outside surface of the roller jacket and that prefabricated, highly wear-resistant hard bodies be pressed into the depressions, namely onto an adhesive compound that fills out the space provided with cavities between the bottom of the depressions and the underside of the hard bodies that have been fitted in.

14 Claims, 3 Drawing Sheets

GRINDING ROLLER AND METHOD FOR THE MANUFACTURE THEREOF

BACKGROUND OF THE INVENTION

The invention is directed to a grinding roller for pressure comminution of granular material, particularly for roller-type presses for inter-particle crushing, comprising a roller jacket with wear-resistant surface armoring that comprises alternating zones of highly wear-resistant material and interspace zones having a different wear resistance. The invention is also directed to a method for the manufacture of the grinding roller.

In roller mills, granular, brittle grinding stock is drawn into the nip by which the two rotatably seated, oppositely rotating rollers are separated from one another and are subjected to a pressure comminution therein. What is referred to as inter-particle crushing in the nip of a high-pressure roller mill or, respectively, roller press is also known, whereby the individual particles of the grinding stock drawn into the nip by friction crush one another in a product bed, i.e., in a material fill compressed between the two roller surfaces given application of a high pressure. It is self-evident that the roller surfaces are thereby subject to a high load and to high wear.

At least the following demands are made of such roller surfaces: They should have a high capability of resisting wear, should be capable of being cost-beneficially manufactured, should be able to be repaired by the operator or, respectively, customer and should also have a good draw-in behavior for the material to be comminuted.

It is known to make the roller surfaces of inter-particle comminution roller mills or, respectively, roller presses more resistant to wear in that a plurality of pre-fabricated, hard metal bodies such as, for example, burl bolts that can be embedded in corresponding channels or, respectively, blind bores of the roller jacket are arranged on the roller surface (EP-B-0516952, FIG. 2). Given what is referred to as this grid armoring, the burl bolts project outward from the roller surface with such a great height and are arranged with such a spacing from one another that the interspaces between the burl bolts remain filled with the compressed, fine-grained product material during operation of the roller mill, this forming an autogenous wear protection for the roller surfaces and exhibiting a good draw-in behavior due to the roughness thereof.

Whereas the welding of pre-fabricated burl bolts would only be possible for manufacturing the grid armoring given a weldable bolt material such as, for example, structural steel or the like, the fastening of pre-fabricated burl bolts in corresponding blind bores of the roller material is comparatively involved in terms of fabrication technology due to the material-removing processing and can practically not be repaired by an operator in case of damage.

EP-B-0659108 also discloses a surface armoring of press rollers having zones of highly wear-resistant material and interspace zones having a material with a different, for example lower wear resistance, whereby the highly wear-resistant zones are formed of lamina-like hard members manufactured by hot isostatic pressing that, like the interspace material composed of sinterable composite material, are secured to the roller member by a hot isostatic pressing process. Due to faster wear of the less wear-resistant interspace material, a profiling of the roller surface is supposed to occur during roller operation that has troughs or, respectively, interspaces arranged between the hard members that are filled with compressed, fine-grained material during operation of the roller press that, as autogenous wear protection, remains in the troughs or, respectively, interspaces between the hard members during the roller revolutions. It is self-evident that this surface armoring of press rollers cannot be repaired at all by an operator.

Further, EP-B-0563564 discloses a grinding roller for an inter-particle roller mill wherein the roller jacket is composed of a wear-resistant chill casting. Profiling weld beads are thereby welded onto the outside surface of the chill casting roller jacket, these beads potentially crossing one another, so that a lozenge-shaped weld bead grid pattern then arises for the purpose of achieving an autogenous wear protection. Apart therefrom that it is problematical to weld chill casting faultlessly, especially when the chill casting material contains a high proportion of carbon, chromium, etc., the fabrication of this chill casting roller jacket with subsequent, specific application welding is involved. The service life of the application weld beads is limited.

SUMMARY OF THE INVENTION

The invention is based on the object of creating a surface armoring suitable for the autogenous wear protection with application of grid armoring technology, particularly for the grinding rollers of high-pressure roller mills or, respectively, roller presses for pressure comminution of granular material, that exhibits a long service life capability as a result of high wear resistance and pressure resistance and that can nonetheless be fabricated relatively simple and cost-beneficially overall and that can also be repaired.

Given the inventive surface armoring of grinding rollers or, respectively, press rollers, depressions spaced from one another are formed in the outside surface of the roller jacket, this being especially easy to accomplish when the roller jacket is composed of a cast metal member, so that any and all chip-removing processing operations such as the application of channels, bores, etc., can be eliminated. Viewed in plan view, the depressions of the roller jacket can be circular, oblong, polygonal, rectangular or rhombic with tips in circumferential roller direction or with tips in axial direction as well. Corresponding, prefabricated, highly wear-resistant hard bodies, particularly of sintered metal, can be fitted into these depressions. The bottom of the depressions and the underside of the hard bodies have been manufactured with a specific surface roughness, for example by hammering, so that cavities can form between the underside of the hard bodies to be fitted in and the bottom of the depressions. Before the hard bodies are fitted into their respective depressions of the roller surface, an adhesive compound is applied in a simple way on the bottom of the depressions and/or on the underside of the hard bodies, this adhesive compound then filling the cavities formed by the surface roughness when the hard bodies are fit in. The hard bodies that have been fitted in are then pressed into their depressions with a tool and a pressure adhesive process is initiated that leads to a very solid connection.

The tool for the implementation of the pressure adhesive process can be an hydraulic of a mechanical press. Especially advantageously, the tool is a hot shrink ring inverted around the hard bodies that have been fitted in, this having been heated to a temperature of, for example, 200° C. and being in turn removed after it has cooled, i.e. after shrinking from the hard bodies that have been pressed in, to which end the shrink ring serving as tool is composed of at least two parts, for example two ring halves.

In order for the shrink ring serving as tool to be able to carry out its function of pressing the hard bodies into the depressions of the roller jacket well and the shrink ring lies flush against the upper sides of the hard bodies to be pressed in, it can be advantageous that the shrink ring comprises radially inwardly directed elevations at its inside in those zones that lie opposite the hard bodies to be pressed in, said elevations having the same shape as the hard metal bodies to be pressed in.

According to a further feature of the invention, the adhesive compound for producing the glued connection between the hard bodies and the bottom of the depressions can also be provided with hard metal splinters such as, for example, hard metal carbide splinters, as a result whereof the strength of the glued connection is further enhanced.

The inventive surface armoring is highly wear-resistant and yet comparatively simple to manufacture. If a glued connection of a hard body were to release during operation of the roller press or, respectively, inter-particle roller mill, then the operator himself can repair the roller surface given such damage. The interspace zones of the roller jacket between the hard bodies fitted into the roller jacket depressions can be protected against wear during operation of the roller machine by the initially described, autogenous wear protection.

The invention and further features and advantages thereof are explained in greater detail on the basis of the exemplary embodiments schematically shown in the Figures.

DETAILED DESCRIPTION OF THE PREFERRED EMBODIMENTS

Figure 1:
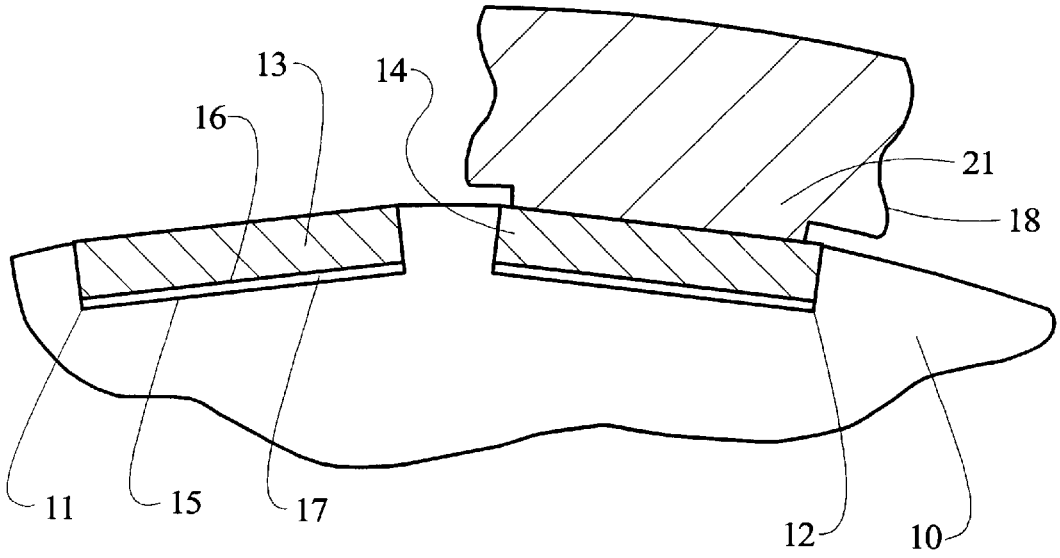
FIG. 1 illustrates portions of the inventive surface armoring for the roller of a high-pressure roller press in a vertical section transverse to the roller axis.
Figure 6:
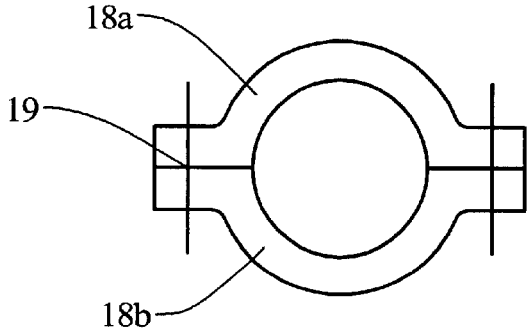
FIG. 6 illustrates an end view of a shrink ring serving as tool.

According to FIG. 1, depressions 11, 12 spaced from one another are formed into the outside surface of a roller jacket 10. Prefabricated, highly wear-resistant hard bodies 13, 14 are fitted into these depressions and can also proceed beyond the outside diameter of the base member in raised fashion. In particular, the hard bodies can be composed of sintered metal and can, for example, have a cylindrical shape according to the plan view of FIG. 2. The diameter of the hard bodies 13, 14 can, for example, amount to 70 mm, and the smallest spacing of neighboring hard bodies from one another can, for example, amount to 20 mm at the parting seams 20. The bottom 15 of the depressions 11, 12 as well as the underside 16 of the hard bodies 13, 14 have been manufactured with a specific surface roughness, so that the two surfaces do not lie flush against one another; rather, small cavities have been formed between the two surfaces. Before the hard bodies 13, 14 are fitted into their respective depressions 11, 12 of the roller surface, an adhesive compound 17 has been applied onto the bottom 15 of the depressions and/or onto the underside 16 of the hard bodies. After the hard bodies 13, 14 have then been inserted into their depressions, a shrink ring 18 (shown excerpted in FIG. 1 and in an end view in FIG. 6) heated to, for example approximately 200° C. is inverted around all cold hard bodies, this shrink ring 18 shrinking as it cools and thereby pressing the hard bodies 13, 14 radially inward onto the adhesive compound 17. After the end of the pressure adhesive process, i.e. after the cooling of the shrink ring 18, this is in turn removed from the hard bodies 13, 14 that have been pressed in, to which end the shrink ring is composed of at least two parts, of the two halves 18*a* and 18*a* with clamp connection according to FIG. 6.

Figure 2:
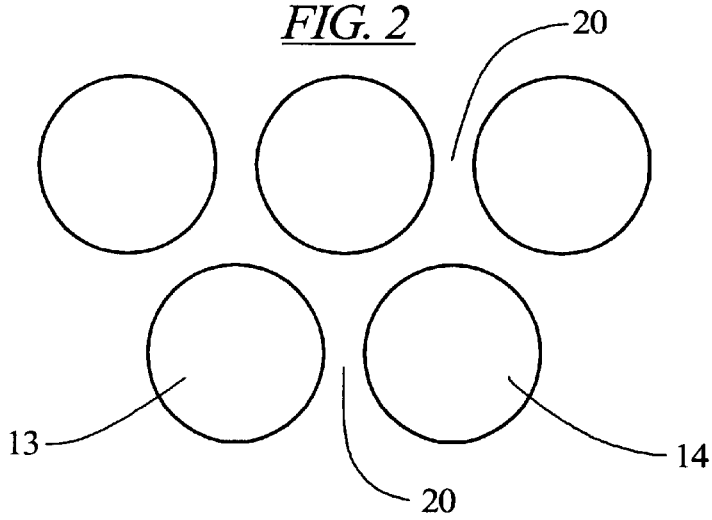
FIG. 2 illustrates in a plan view, in somewhat reduced scale, the surface armoring of FIG. 1 having a plurality of neighboring hard bodies fitted into the roller jacket.
Figure 3:
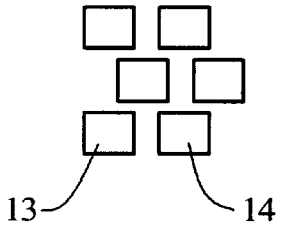
FIGS. 3–5 illustrate in a further-reduced scale, the plan view onto hard bodies fitted in the roller jacket neighboring one another with respectively different configurations.
Figure 4:
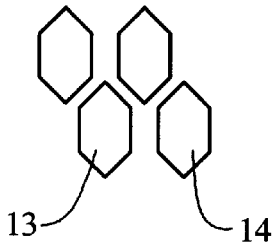
Figure 5:
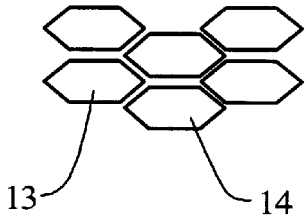

The hard metal bodies 13, 14, which can have a cylindrical shape according to the plan view of FIG. 2, can, however, also be rectangular, polygonal, quadratic according to FIG. 3, or rhombic with tips in circumferential direction according to FIG. 4 or rhombic with tips in axial direction according to FIG. 5, etc.

It is important that, as proceeds from FIG. 2, the parting seams or lands 20 between neighboring hard bodies 13, 14 are clearly smaller than the hard bodies themselves and are arranged offset relative to one another, so that no circumferential furrows arise on the roller surface, which would then lead to a corresponding wear of the roller surface.

It can also be seen in FIG. 1 that the inside of the shrink ring 18 serving as tool can comprise corresponding, radially inwardly directed elevations 21 in the zones that lie opposite the hard bodies 13, 14 to be pressed in, these elevations lying flush against the upper sides of the hard bodies 13, 14, as a result whereof a reliable transmission of the forces onto the fitted-in hard bodies 13, 14 is assured during the shrinking of the slipped-on shrink ring 18.

When the roller jacket 10 of the grinding roller is a cast metal member, then it can also have been manufactured of at least two different, molten casting compounds in a single casting process. The at least two casting compounds are distributed such in the composite casting that a harder cast metal compound is concentrated in the outer region of the roller jacket and a softer cast metal compound is concentrated in the radially inner region of the roller jacket. The metal casting compounds can be matched to one another such that there is good material compatibility in the mixing zone region and no stresses occur. The overall roller jacket 10 can be manufactured in a spin casting process, whereby the harder metal casting compound is first spun into a corresponding form and the softer as well as more viscous casting metal compound is subsequently spun in. Given this composite casting, the depressions 11, 12 are simultaneously formed in the outside surface of the roller jacket 10, as a result whereof a chip-removing processing of the roller jacket is eliminated. Advantageously, the casting material located in the outer region of the roller jacket 10 can have a hardness of more than 55 HRC (hardness test according to Rockwell C). The casting material can be alloyed with chromium and can also contain special carbides as well as other hard alloy constituents.

Figure 7:
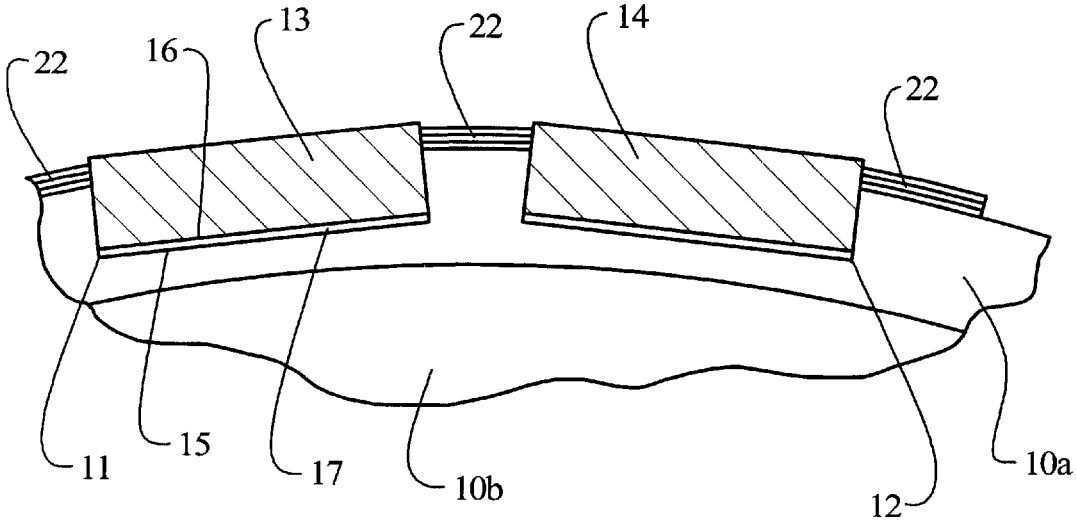
FIG. 7 illustrates an alternative embodiment of the roller jacket of FIG. 1 along with the use of lamellae between adjacent hard bodies.

When the highly wear-resistant hard bodies 13, 14 are arranged projecting from the roller surface, such as shown in FIG. 7, prefabricated, highly wear-resistant lamellae 22 manufactured, in particular, powder-metallurgically or powder-ceramically can be secured in the interspaces between the neighboring, prefabricated hard bodies 13, 14 according to a further feature of the invention; these lamellae 22 can be supported against the inserted hard bodies 13, 14 to prevent lateral dislocation. These highly wear-resistant lamellae 22, which can protect the surface of the roller jacket

10 against premature wash-out between the hard bodies 13, 14 and lengthen the service life of the hard bodies 13, 14, can be connected to the roller jacket 10 with a glued connection, a soldered connection, by hot isostatic pressing or with a positive lock as well. This additional anti-wear measure can also be applied to roller jackets that are not composed of metal casting but, for example, of rolled material.

As shown in FIG. 7, a separate ring band 10*a* can be secured to a roller base member 10*b*, and the hard bodies 13, 14 can be attached to the ring band 10*a*. Preferably the ring band 10*a* is first secured on the roller base member without introduced bard bodies, particularly by being shrunken thereon and/or by gluing. Subsequently the hard bodies 13, 14 are inserted into the depressions 11, 12 of the ring band 10*a* and the heated shrink ring 18 is inverted around the fitted-in hard bodies 13, 14 as a tool for the implementation of the pressure adhesive process.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A grinding roller for the pressure comminution of granular material, particularly for roller presses for interparticle comminution, comprising a roller jacket having a wear-resistant surface armoring that comprises alternating zones of highly wear-resistant material and interspace zones with a different wear resistance, comprising:

depressions spaced from one another and formed into an outside surface of the roller jacket;

prefabricated, highly wear-resistant hard bodies secured in the depressions; and cavities presented by corresponding surface roughnesses formed between the bottom of the depressions and the underside of the hard bodies, said cavities being filled by an adhesive compound, wherein the adhesive compound is provided with hard metal splinters.

2. A grinding roller according to claim 1, wherein the hard metal splinters comprise carbide splinters.

3. A grinding roller according to claim 1, wherein the depressions of the roller jacket as well as the inserted hard bodies are one of circular, polygonal, rectangular, quadratic and rhombic.

4. A grinding roller according to claim 3, wherein said hard bodies have tips arranged in one of circumferential roller direction and axial direction.

5. A grinding roller according to claim 1, wherein the roller jacket is formed of a cast metal member.

6. A grinding roller according to claim 1, wherein prefabricated, highly wear-resistant lamellae are secured in the interspaces between the neighboring, prefabricated highly wear-resistant, introduced hard bodies.

7. A grinding roller according to claim 6, wherein said lamellae are supported against the inserted hard bodies to prevent lateral dislocation.

8. A grinding roller according to claim 6, wherein said lamellae are manufactured by one of powder-metallurgically and powder-ceramically.

9. A grinding roller according to claim 6, wherein the wear-resistant lamellae are connected to the roller jacket with at least one of a glued connection, a soldered connection, by hot isostatic pressing and a positive lock.

10. A grinding roller for the pressure comminution of granular material, particularly for roller presses for interparticle comminution, comprising a roller jacket formed of a cast metal member having a wear-resistant surface armoring that comprises alternating zones of highly wear-resistant material and interspace zones with a different wear resistance, comprising:

depressions spaced from one another and formed into an outside surface of the roller jacket;

prefabricated, highly wear-resistant hard bodies secured in the depressions; and cavities presented by corresponding surface roughnesses formed between the bottom of the depressions and the underside of the hard bodies, said cavities being filled by an adhesive compound, wherein the cast metal member roller jacket is composed of at least two different casting compounds such that a harder casting compound is concentrated in the outer region of the roller jacket and a softer casting compound is concentrated in the radially inner region of the roller jacket.

11. A grinding roller according to claim 10, wherein the casting material located in the outer region of the roller jacket is composed of a chromium-alloyed hard casting.

12. A grinding roller for the pressure comminution of granular material comprising a roller jacket having a wear-resistant surface armoring that comprises alternating zones of highly wear-resistant material and interspace zones with a different wear resistance, comprising:

depressions spaced from one another and formed into an outside surface of the roller jacket with a bottom of the depressions being fabricated with a surface roughness;

prefabricated, highly wear-resistant hard bodies secured in the depressions, said hard bodies having an underside fabricated with a surface roughness, and cavities formed by the adjacent surface roughnesses of the bottom of the depressions and the underside of the hard bodies, the cavities being filled by an adhesive compound, wherein the roller jacket comprises a ring band secured to a roller base member, with the depressions being formed in the ring band.

13. A grinding roller according to claim 12, wherein said ring band is attached to said roller base member with a friction fit.

14. A grinding roller according to claim 12, wherein the ring band is attached to the roller base member by an adhesive.

* * * * *